US012686549B2

(12) United States Patent
Mannion et al.

(10) Patent No.: US 12,686,549 B2
(45) Date of Patent: Jul. 21, 2026

(54) PACKAGE AND METHOD OF USE FOR MANAGING EXCESS LASER FIBER

(71) Applicant: C. R. Bard, Inc., Franklin Lakes, NJ (US)

(72) Inventors: Paul Thomas Mannion, Eliot, ME (US); Alex Ivlev, Milcreek, UT (US)

(73) Assignee: C. R. Bard, Inc., Franklin Lakes, NJ (US)

( * ) Notice: Subject to any disclaimer, the term of this patent is extended or adjusted under 35 U.S.C. 154(b) by 180 days.

(21) Appl. No.: 18/290,444

(22) PCT Filed: May 11, 2022

(86) PCT No.: PCT/US2022/028693
§ 371 (c)(1),
(2) Date: Nov. 13, 2023

(87) PCT Pub. No.: WO2022/240935
PCT Pub. Date: Nov. 17, 2022

(65) Prior Publication Data

US 2024/0253887 A1 Aug. 1, 2024

Related U.S. Application Data

(60) Provisional application No. 63/188,969, filed on May 14, 2021.

(51) Int. Cl.

| | |
|---|---|
| ***B65D 75/56*** | (2006.01) |
| ***B65D 75/58*** | (2006.01) |
| ***B65D 85/04*** | (2006.01) |
| ***B65D 85/20*** | (2006.01) |

(52) U.S. Cl.
CPC ..... *B65D 75/5888* (2013.01); *B65D 75/56* (2013.01); *B65D 85/04* (2013.01); *B65D 85/20* (2013.01)

(58) Field of Classification Search
CPC .... B65D 75/5888; B65D 75/56; B65D 85/04; B65D 85/20
See application file for complete search history.

(56) References Cited

U.S. PATENT DOCUMENTS 5,263,585 A * 11/1993 Lawhon ..... G02B 6/4453 242/129

FOREIGN PATENT DOCUMENTS

WO 2015046221 A1 4/2015
WO 2022240935 A1 11/2022

OTHER PUBLICATIONS

PCT/US2022/028693 filed May 11, 2022 International Search Report and Written Opinion dated Aug. 18, 2022.

* cited by examiner

*Primary Examiner* — Ankit D Tejani
*Assistant Examiner* — Joshua Brendon Solomon
(74) *Attorney, Agent, or Firm* — Rutan & Tucker LLP

(57) ABSTRACT

Disclosed herein is a laser fiber surrounded by tubular package, the tubular package having a plurality of sections along a length of the tubular package, each of the plurality of sections connected to an adjacent section by a circumferential tear line, each of the plurality of sections including a length marking.

21 Claims, 7 Drawing Sheets

PACKAGE AND METHOD OF USE FOR MANAGING EXCESS LASER FIBER

PRIORITY

This application is a U.S. national stage application of International Application No. PCT/US2022/028693, filed May 11, 2022, which claims the benefit of priority to U.S. Provisional Application No. 63/188,969, filed May 14, 2021, each of which is incorporated by reference in its entirety into this application.

BACKGROUND

In medical procedures using a laser system including laser fiber, it can be difficult to determine the proper length of the laser fiber needed to extend from the laser module to the patient. The proper length can be defined by factors such as where the laser module is located in the room with respect to the patient. When the laser system is located near the patient, an excess length of the laser fiber may result due to the short distance between the laser system and the patient. Current methods of managing this excess length include wrapping it in a wet cloth and placing it near the patient. It would be beneficial for the user and the patient to have a better method to determine the proper length of needed laser fiber and manage any excess length of the laser fiber. Disclosed herein is an apparatus and method of use that addresses the foregoing.

SUMMARY

Disclosed herein is a medical device that, according so some embodiments, includes: a laser fiber defining a proximal end and a distal end, where the laser fiber includes a connector at the proximal end; and a tubular package extending along the laser fiber, where the laser fiber is disposed within the tubular package. The tubular package includes a number of sections along a length of the tubular package, and adjacent sections of the number of sections are configured for separation from each other during use of the laser fiber.

In some embodiments, the tubular package defines a coiled shape.

In some embodiments, the tubular package is formed of a rigid material to maintain the coiled shape during use.

In some embodiments, the tubular package is configured for securement to a laser system during use.

In some embodiments, the adjacent sections are coupled together via a frangible joint, and the frangible joint is configured for separation by a clinician during use.

In some embodiments, each of the number of sections includes a length marking.

In some embodiments, each length marking indicates a length of the laser fiber extending between the length marking and the connector.

In some embodiments, each length marking is engraved or stamped onto the tubular package.

In some embodiments, one or more of the number of sections includes a separable seam extending longitudinally along the tubular package.

In some embodiments, the connector is disposed external the package.

In some embodiments, the package is disposable.

Also disclosed herein is a method of managing an excess length of a medical laser fiber during a medical procedure. According to some embodiments, the method includes: (i) coupling a connector of the laser fiber to a laser system, the laser fiber disposed within a tubular package; (ii) determining a desired length of the laser fiber for use in performing a medical procedure; (iii) removing a portion of the tubular package to expose the desired length of the laser fiber; and (iv) securing an excess length of the laser fiber to the laser system, the excess length disposed within the tubular package.

In some embodiments of the method, the tubular package includes a number of sections, and adjacent sections of the number of sections are configured for separation from each other by a clinician during use of the laser fiber.

In some embodiments of the method, each of the number of sections includes a length marking.

In some embodiments of the method, each length marking indicates a length of the laser fiber extending between the connector and the length marking.

In some embodiments of the method, determining the desired length of the laser fiber includes using the length marking to determine a portion of the tubular package to be removed from the laser fiber.

In some embodiments of the method, removing the tubular package to expose the laser fiber includes separating one or more of the adjacent sections from each other.

In some embodiments of the method, removing the tubular package to expose the laser fiber further includes threading one or more number of sections off a distal end of the laser fiber.

In some embodiments of the method, one or more of the number of sections includes a separable seam extending longitudinally along the tubular package.

In some embodiments of the method, removing the tubular package to expose the laser fiber includes separating the separable seam of one or more of the number of sections to expose the laser fiber.

In some embodiments of the method, the tubular package defines a rigid coiled shape, and organizing the excess length of the laser fiber includes maintaining the excess length of the laser fiber within the tubular package.

In some embodiments of the method, 18. The method according to claim 17, wherein securing the excess length of the laser fiber to the laser system includes hanging the tubular package on a hook of the laser system. These and other features of the concepts provided herein will become more apparent to those of skill in the art in view of the accompanying drawings and following description, which describe particular embodiments of such concepts in greater detail.

DRAWINGS

A more particular description of the present disclosure will be rendered by reference to specific embodiments thereof that are illustrated in the appended drawings. It is appreciated that these drawings depict only typical embodiments of the invention and are therefore not to be considered limiting of its scope. Example embodiments of the invention will be described and explained with additional specificity and detail through the use of the accompanying drawings in which.

DESCRIPTION

Figure 1A:
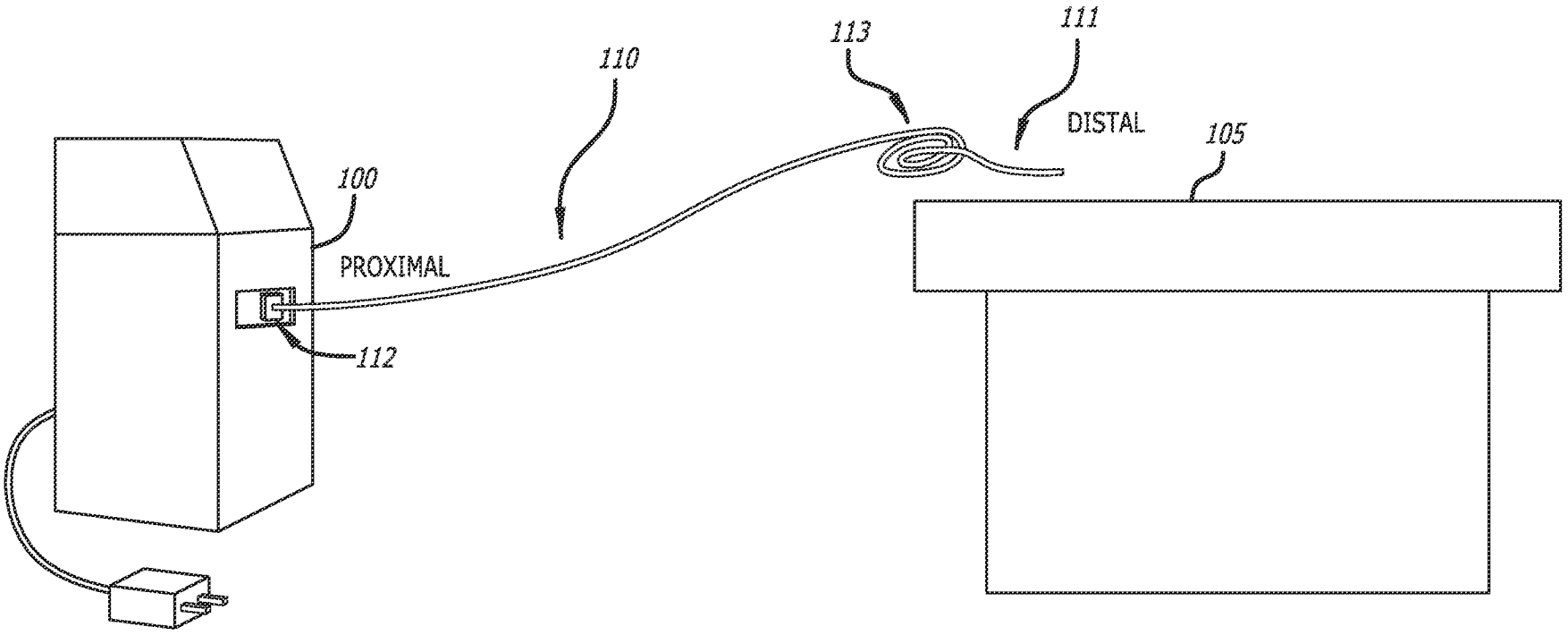
FIG. 1A illustrates a perspective view of a laser system including a laser fiber, in accordance with some embodiments.

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

With respect to "proximal," a "proximal portion" or a "proximal-end portion" of, for example, a laser fiber disclosed herein includes a portion of the laser fiber intended to be near a laser system when the laser fiber is used on a patient. Likewise, a "proximal length" of, for example, the laser fiber includes a length of the laser fiber intended to be near the laser system when the laser fiber is used on the patient. A "proximal end" of, for example, the laser fiber includes an end of the laser fiber intended to be near the laser system when the laser fiber is used on the patient. The proximal portion, the proximal-end portion, or the proximal length of the laser fiber can include the proximal end of the laser fiber; however, the proximal portion, the proximal-end portion, or the proximal length of the laser fiber need not include the proximal end of the laser fiber. That is, unless context suggests otherwise, the proximal portion, the proximal-end portion, or the proximal length of the laser fiber is not a terminal portion or terminal length of the laser fiber.

With respect to "distal," a "distal portion" or a "distal-end portion" of, for example, a laser fiber disclosed herein includes a portion of the laser fiber intended to be near or in a patient when the laser fiber is used on the patient. Likewise, a "distal length" of, for example, the laser fiber includes a length of the laser fiber intended to be near or in the patient when the laser fiber is used on the patient. A "distal end" of, for example, the laser fiber includes an end of the laser fiber intended to be near or in the patient when the laser fiber is used on the patient. The distal portion, the distal-end portion, or the distal length of the laser fiber can include the distal end of the laser fiber; however, the distal portion, the distal-end portion, or the distal length of the laser fiber need not include the distal end of the laser fiber. That is, unless context suggests otherwise, the distal portion, the distal-end portion, or the distal length of the laser fiber is not a terminal portion or terminal length of the laser fiber.

Unless defined otherwise, all technical and scientific terms used herein have the same meaning as commonly understood by those of ordinary skill in the art.

FIG. 1A illustrates a perspective view of a laser system 100 including a laser fiber 110 (medical device), in accordance with some embodiments. The laser system 100 may be used in performing medical procedures including laser lithotripsy. The laser fiber 110 includes an optical fiber to transmit the laser from the laser system 100 to a patient. The laser fiber 110 includes a connector 112 at proximal end, where connector 112 is configured to operatively couple the laser fiber 110 to the laser system 100. A distal end portion of the laser fiber 110 is configured for engagement with the patient.

The laser fiber 110 may be disposed within a package configured to organize the laser fiber 110 before and during use as shown and described below. The package may also define a microbial barrier to maintain sterility of the laser fiber 110 before use. During use, the entire length of the laser fiber 110, or a portion thereof, may be removed from the package. As shown, in some instances, the entire length of the laser fiber 110 exceeds the necessary length to extend from the laser system 100 to a location of the patient. In such instances, an excess length 113 of the laser fiber 110 may be coiled and placed on or near a patient bed 105 or near the laser system 100.

Figure 1B:
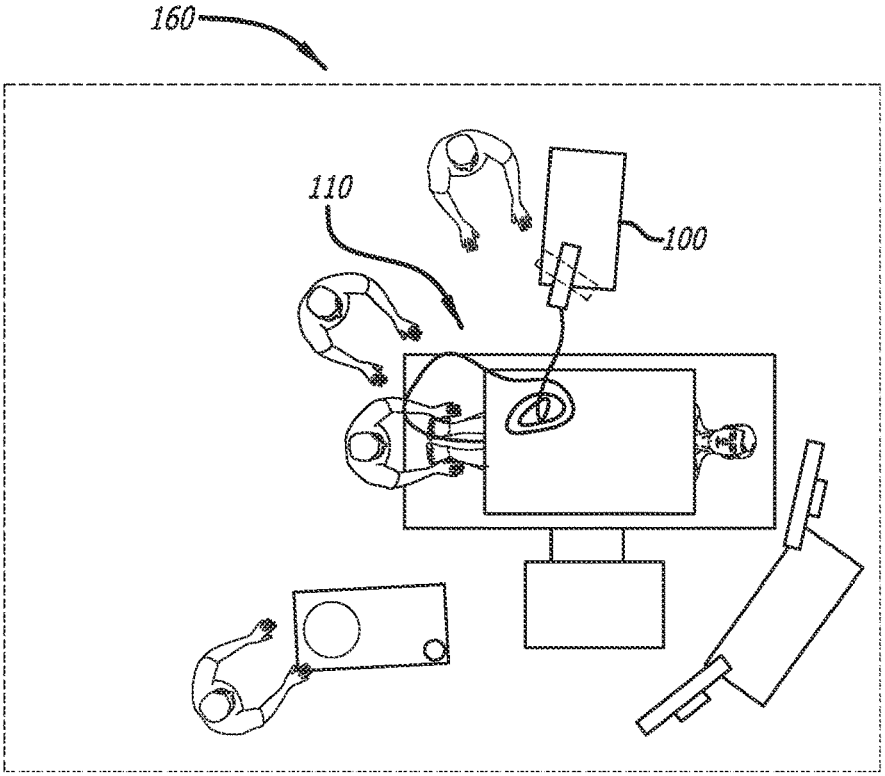
FIGS. 1B-1C illustrate a plan view of different arrangements of the laser system during a medical procedure, in accordance with some embodiments.
Figure 1C:
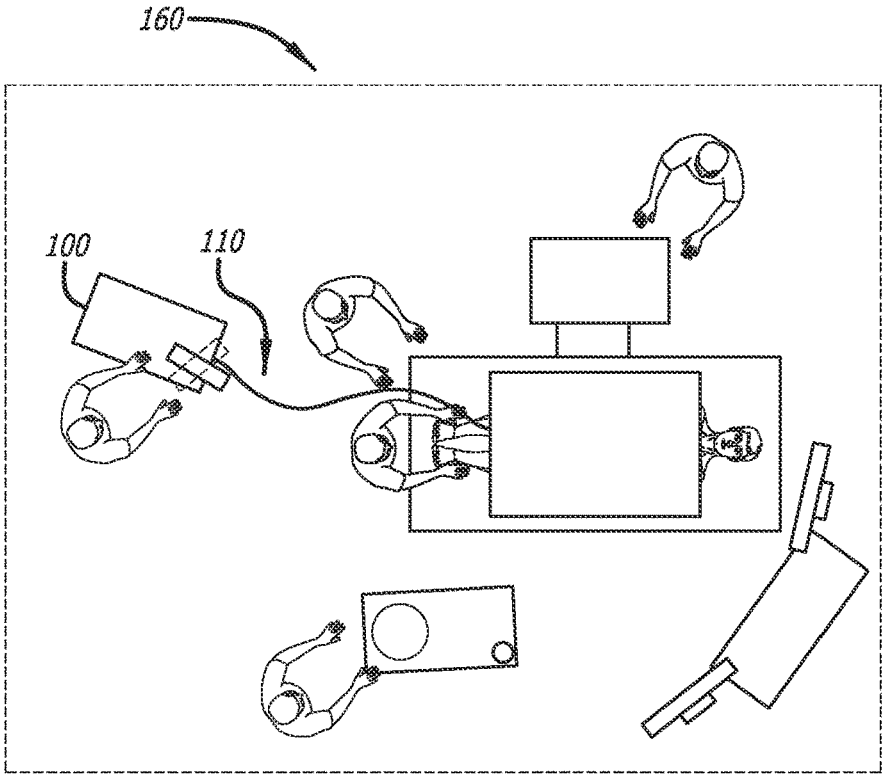

FIGS. 1B-1C illustrate a plan view of different arrangements of the laser system 100 during a medical procedure, in accordance with some embodiments. During the medical procedure, the laser system 100 may be located at various locations within an operating room 160, depending on physician preference and the location of available electrical outlets. In some embodiments, as illustrated in FIG. 1B, the laser system 100 may be positioned near a patient, resulting in a length of excess laser fiber 110 that needs to be managed. In some embodiments, as illustrated in FIG. 1C, the laser system 100 may be positioned further away from the patient, resulting in little or no excess length of the laser fiber 110.

Figure 2A:
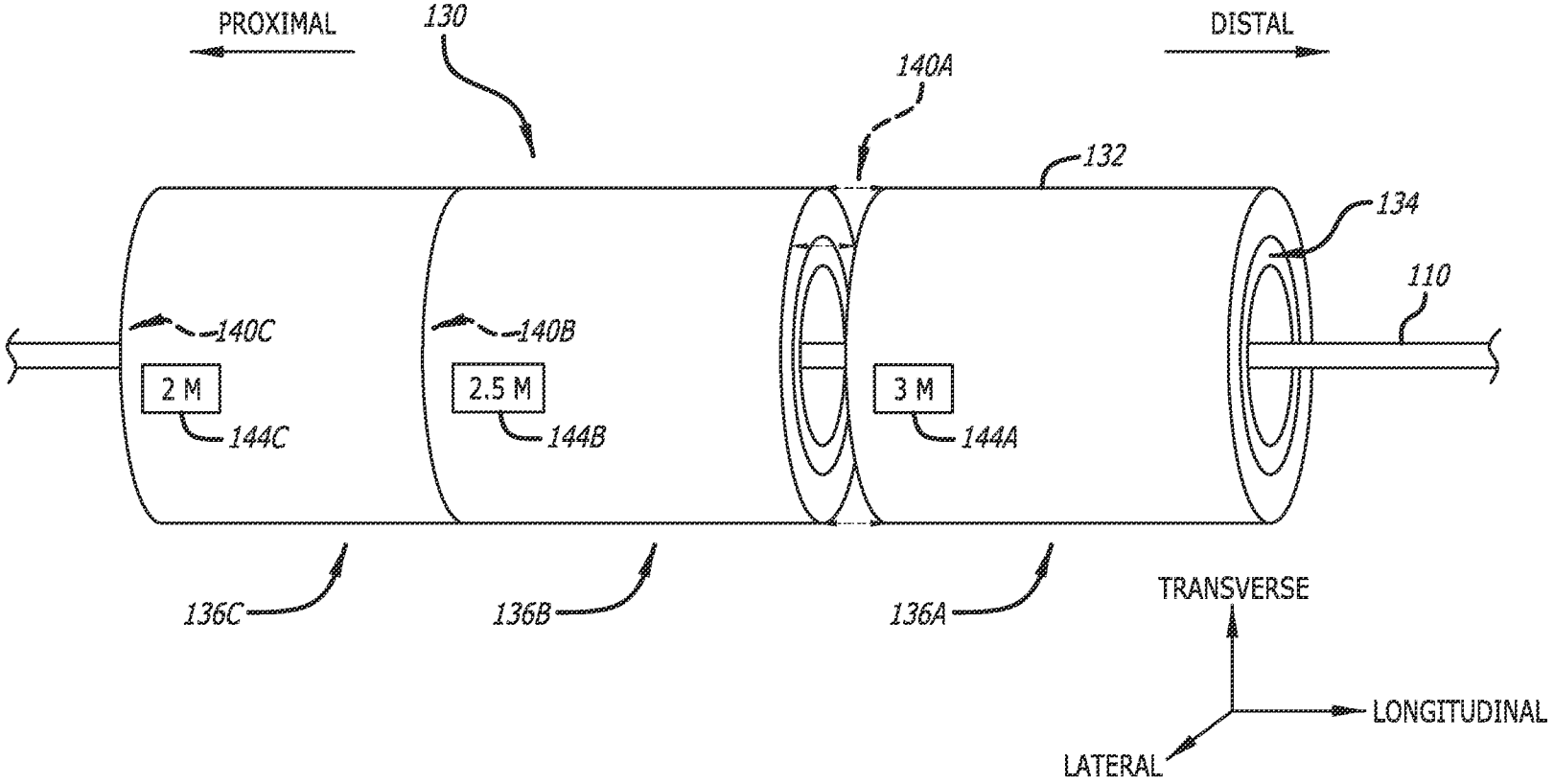
FIG. 2A illustrates a side view of a portion of a package having the laser fiber disposed therein, in accordance with some embodiments.

FIG. 2A illustrates a perspective view of the laser fiber package (package) 130, in accordance with some embodiments. The package 130 may be configured to protect and organize the laser fiber 110 during shipping and handling of the laser fiber 110. The package 130 may also be configured to manage an excess length of the laser fiber 110 during use. The package 130 may also be configured to define a microbial barrier to maintain a sterility of at least a distal portion of the laser fiber 110. The package 130 includes an elongate body 132 defining a lumen 134 configured for receiving the laser fiber 110. The laser fiber 110 may be slidably disposed within the package 130. In some embodiments, the package 130 may define a closed distal end (not shown). In some embodiments, a proximal portion of the package 130 may be configured for receiving the connector 112.

The package 130 may include a number (e.g., 1, 2, 3, 4, 5, or more) of separable sections 136 along a length of the package 130. By way of example, the package 130 may include three sections 136A-136C extending along a length of the package 130. Each section 136 of the sections 136A-136C defines a length portion of the elongate body 132. The elongate body 132 may define any suitable cross section, such as a circular or polygonal cross section, for example. Each of the sections 136A-136C are connected to an adjacent section by a separable joint 140 (e.g., a circumferential tear line). The joint 140 defines a frangible portion configured to allow adjacent sections to be separated from one another by the clinician applying a separating force thereto. The force to separate the sections 136 may include a pulling force, a pushing force, a twisting force, or a combination thereof. The joint 140 can include a score line, a groove, a laser cut line, a perforation, a thinned portion, or similar structure to facilitate separation of the joint 140. Each of the sections 136A-136C may be configured to be separated from an adjacent section along the joints 140A-140C. Once separated, each section of the plurality of sections 136A-136C may be distally threaded off the laser fiber 110 to expose a portion of the laser fiber 110 for use. Similarly, the laser fiber 110 or a portion thereof may be proximally extracted from the package 130.

In some embodiments, each section of the sections 136A-136C may include a length marking 144. The length marking may indicate a length of the respective section or some other length, such as the distance between the length marking 144 and the connector 112, for example. In some embodiments, the length marking 144 may indicate the distance each marking 144A-144C is from the connector 112. The length marking 144A-144C may be applied to the package 130 via any suitable process, such as engraving, stamping, or printing, for example.

Figure 2B:
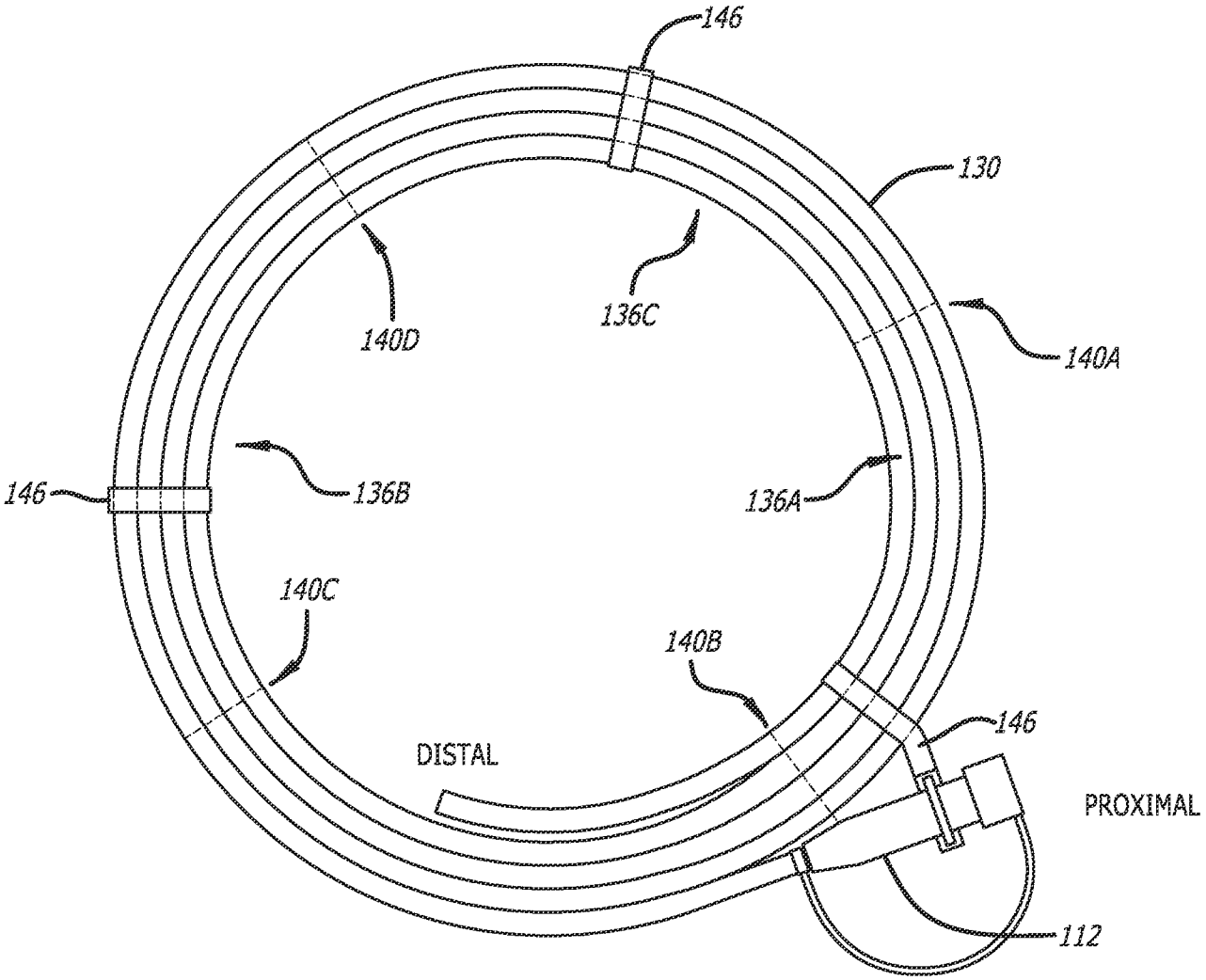
FIG. 2B illustrates a top view of the package of FIG. 2A having a coiled shape, in accordance with some embodiments.

FIG. 2B illustrates a perspective view of the package 130 having the laser fiber 110 disposed therein, in accordance with some embodiments. The package 130 may define a coiled shape having a number of windings. The package 130 may include a rigidity so as to maintain the coiled shape during use. In some embodiments, the proximal end of the laser fiber 110 may include the connector 112, and the connector 112 may be disposed external the package 130. During use, the clinician may determine the length of the laser fiber 110 to perform the treatment. The clinician may remove a portion the package 130 from the determined length of the laser fiber 110, leaving an excess length of the laser fiber 110 within a remaining portion of the package 130. Leaving the excess length of the laser fiber 110 within the package 130 allows the excess length of the laser fiber 110 to be organized and protected by the package 130. The package 130 is configured to secure the excess length of the laser fiber 110 to the laser system 100, e.g., hang the excess length of the laser fiber 110 on a housing of the laser system 100. The sections 136A-136C, defining the joints 140A-140D, may be spaced equidistantly along the length of the package 130. In some embodiments, the sections 136A-136C may be spaced closer together towards the distal end of the package 130 and further apart towards the proximal end of the package 130. In some embodiments, the sections 136A-136C may be spaced a defined distance apart (e.g., 6 inches, 12 inches, 18 inches or the like). In some embodiments, the package 130 may be constructed of hardened plastic (e.g., PEEK, PTFE, PPSU, PSU, PU, Nylon, PEBAX, PP, PE, ABS, EVA, PETG, PVDF, or the like). In some embodiments, windings of the package 130 or the sections 136A-136C may be coupled together via attachment devices 146 to help maintain the coiled shape, where the attachment devices 146 may include an adhesive or an adhesive tape, for example. In other words, portions of the package 130 coupled together to manage an excess length of the laser fiber 110 disposed within the package 130. In some embodiments, the package 130 may be disposable.

Figure 2C:
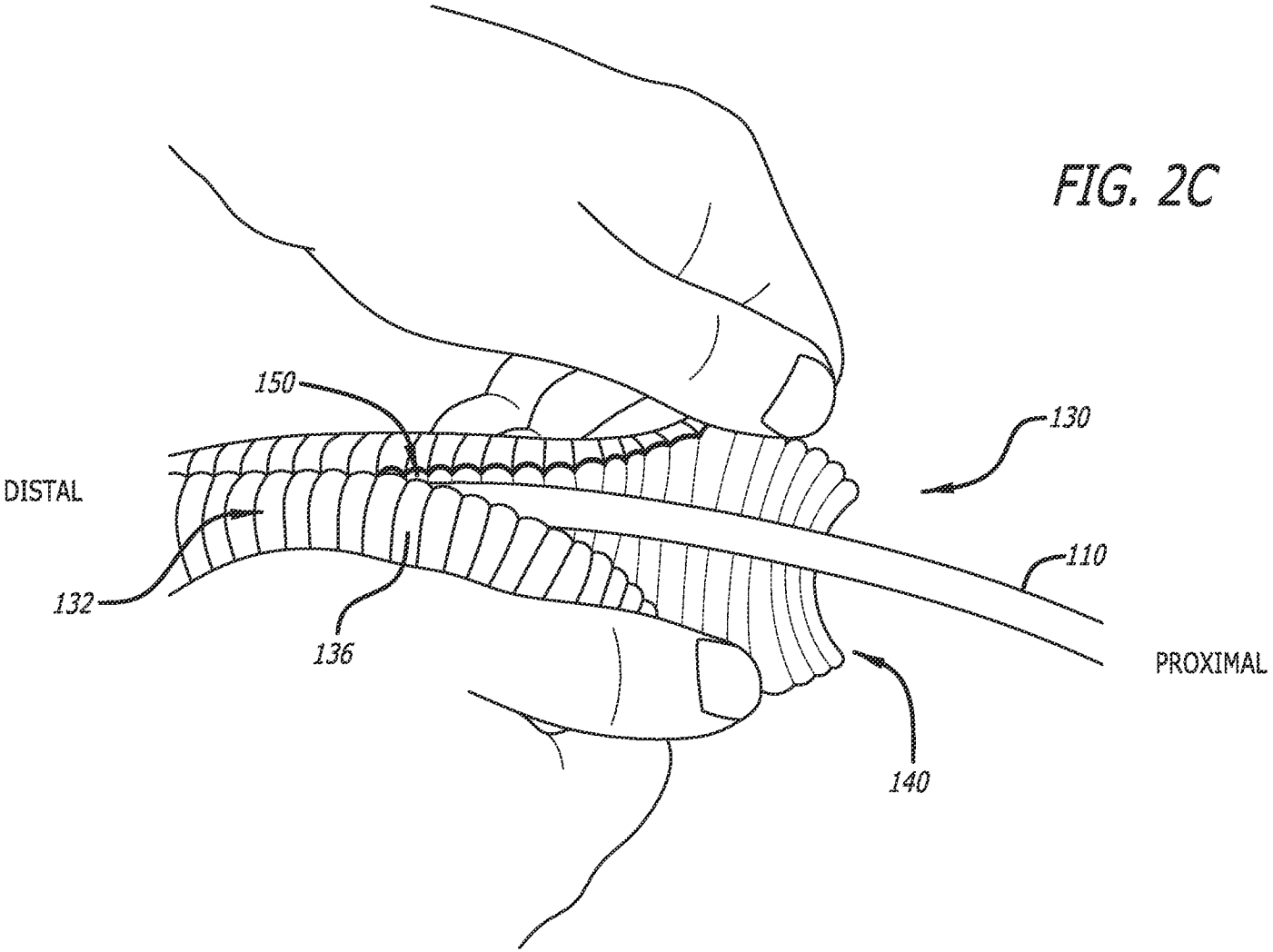
FIG. 2C illustrates a perspective view of another embodiment of the package of FIGS. 2A-2B having a longitudinal seam, in accordance with some embodiments.

FIG. 2C illustrates a perspective view of another embodiment of the package 130. In such an embodiment, the package 130 may include the joint 140 and further include a seam 150 extending longitudinally along the package 130 that allows the laser fiber 110 to laterally separated from the package 130. The seam 150 may include tear line or the seam 150 may include a slit biased toward a closed configuration. In some embodiments, the seam 150 may extending along one or more of the sections 136, or along an entire length of the package 130. For example, the seam 150 may extend long sections 136 that are located along a distal portion of the package 130, since such distally located sections 136 are more likely to be removed to during use. Advantageously, the seam 150 allows the user to laterally separate a section 136 from the laser fiber 110 without having to longitudinally thread the section 136 off the distal end of the laser fiber 110, thereby saving clinician time during setup of the laser fiber 110.

Figure 3A:
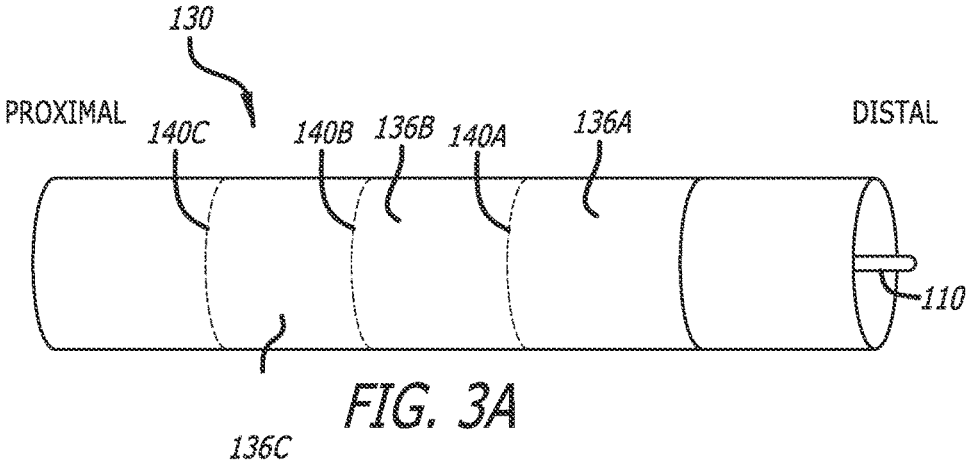
FIGS. 3A-3D illustrate a perspective views of the package sections of FIGS. 2A-2B and the package embodiment of FIG. 2C in various states of separation to expose laser fiber, in accordance with some embodiments.
Figure 3B:
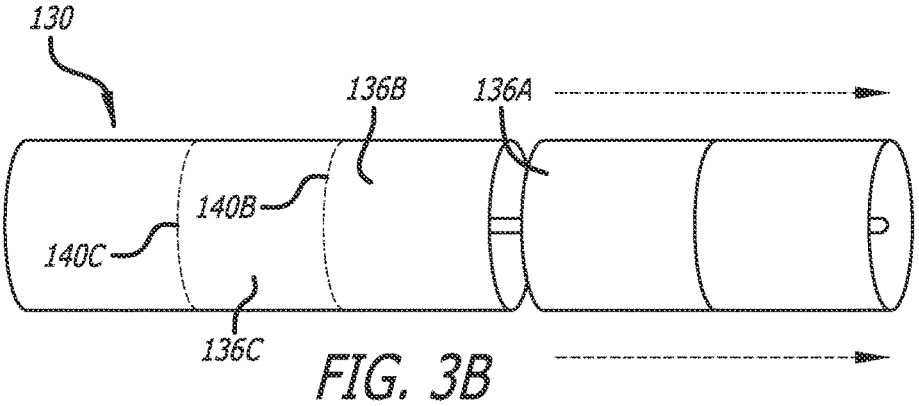
Figure 3C:
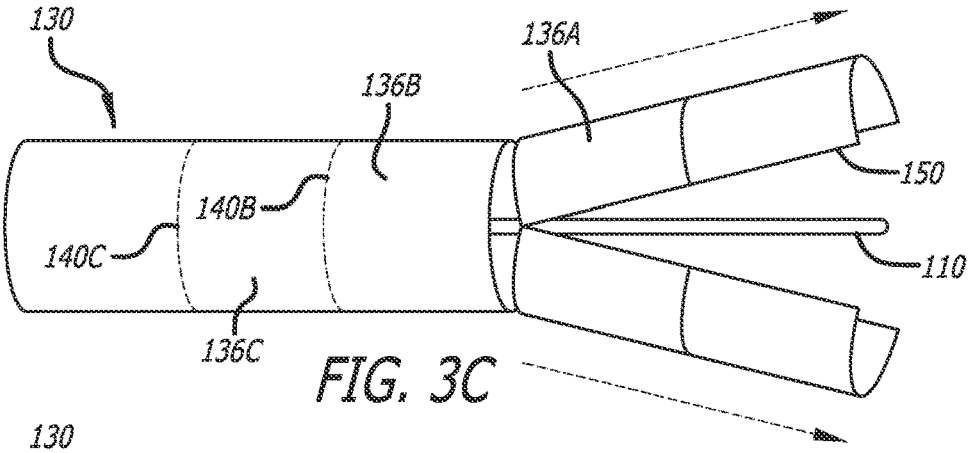
Figure 3D:
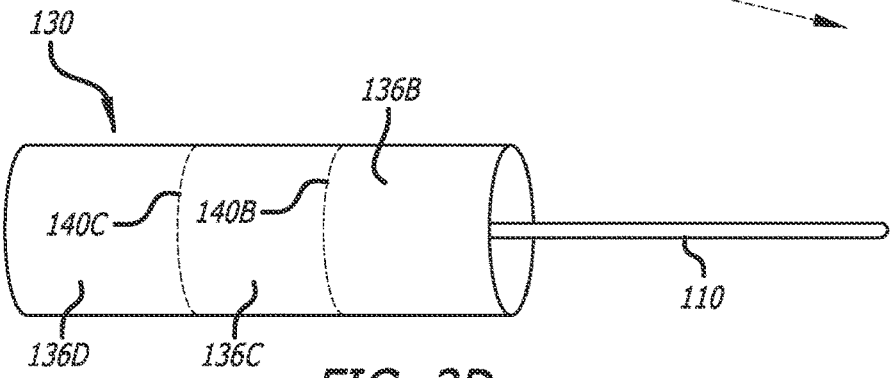

FIGS. 3A-3D illustrate a perspective view of separating the package 130 to expose to the laser fiber 110, in accordance with some embodiments. The proximal end of the laser fiber 110 is coupled to the laser system 100 (see FIGS. 1A-1C) while the laser fiber 110 is contained within the package 130 as illustrated in FIG. 3A. In some embodiments, the package 130 includes the sections 136A-136D defining the joints 140A-140C. The user may determine the desired length of the laser fiber 110. Once the user has determined the desired length of the laser fiber 110, the user may remove the section 136A of package 130 to expose the laser fiber 110. The user may remove the section 136A by separating the section 136A from section 136B along the joint 140A and sliding the section 136A in the distal direction, along the laser fiber 110 as illustrated in FIG. 3B. In some embodiments, the user may remove the section 136A from section 136B by separating the section 136A along the joint 140A and further remove the section 136A from the laser fiber 110 by separating the section 136A along the seam 150 to expose the laser fiber 110 as illustrated in FIG. 3C. The remaining sections 136B-136D of the package 130 may remain on the laser fiber 110 to be organized into a coil and secured to the laser system 100.

Figure 4:
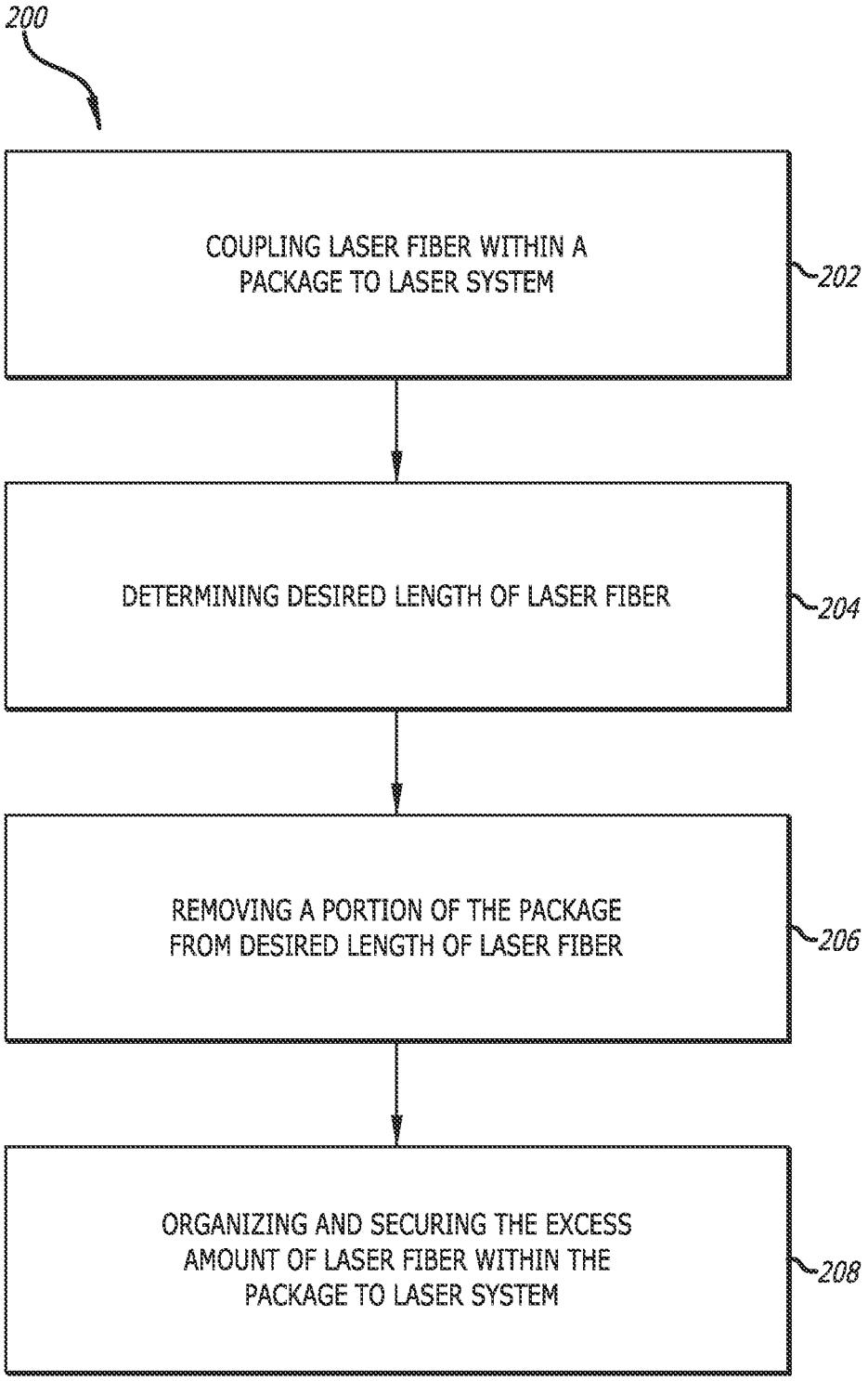
FIG. 4 illustrates a flow chart of an exemplary method of managing an excess length of the laser fiber, in accordance with some embodiments.

FIG. 4 illustrates a flow chart of the exemplary method 200 of managing an excess length of the laser fiber 110, in accordance with some embodiments. In some embodiments, the method 200 includes coupling the laser fiber 110 within the package 130 to the laser system 100 (block 202). In some embodiments, coupling includes coupling the connector 112 of the laser fiber 110 to the laser system 100 while the remainder of the laser fiber 110 is disposed within the package 130. The method 200 further includes determining the desired length of the laser fiber 110 (block 204). In some embodiments, determining can include using the length markings 144 on the package 130 to determine the portion of a package 130 to be removed from the laser fiber 110. The method 200 further includes removing the portion of the package 130 to expose the desired length of the laser fiber 110 (block 206). In some embodiments, removing the package 130 includes separating adjacent sections 136 of the package 130 from each other at the joint 140. In some embodiments, removing includes sliding the separated sections 136 along the longitudinal axis in the distal direction to expose the laser fiber 110. In some embodiments, removing includes separating the section 136 along the seam 150 to expose the laser fiber 110. The method 200 further includes organizing and securing the package 130 to the laser system 100, the excess length of the laser fiber 110 disposed within the package 130 (block 208). In some embodiments, organizing the excess laser fiber 110 includes coiling the excess laser fiber 110. In some embodiments, securing the excess laser fiber 110 to the laser system 100 includes hanging package 130 on a hook of the laser system 100.

While some particular embodiments have been disclosed herein, and while the particular embodiments have been disclosed in some detail, it is not the intention for the particular embodiments to limit the scope of the concepts provided herein. Additional adaptations and/or modifications can appear to those of ordinary skill in the art, and, in broader aspects, these adaptations and/or modifications are encompassed as well. Accordingly, departures may be made from the particular embodiments disclosed herein without departing from the scope of the concepts provided herein.

What is claimed is:

1. A medical device, comprising:

a laser fiber defining a proximal end and a distal end, the laser fiber including a connector at the proximal end; and a tubular package extending along the laser fiber, the laser fiber disposed within the tubular package, wherein:

the tubular package includes a number of sections along a length of the tubular package, and adjacent sections of the number of sections are configured for separation from each other during use of the laser fiber.

2. The medical device according to claim 1, wherein the tubular package defines a coiled shape.

3. The medical device according to claim 2, wherein the tubular package is formed of a rigid material to maintain the coiled shape during use.

4. The medical device according to claim 1, wherein the tubular package is configured for securement to a laser system module during use.

5. The medical device according to claim 1, wherein:

the adjacent sections are coupled together via a frangible joint, and the frangible joint is configured for separation by a clinician during use.

6. The medical device according to claim 1, wherein each of the number of sections includes a length marking.

7. The medical device according to claim 6, wherein each length marking indicates a length of the laser fiber extending between the length marking and the connector.

8. The medical device according to claim 6, wherein each length marking is engraved or stamped onto the tubular package.

9. The medical device according to claim 1, wherein one or more of the number of sections includes a separable seam extending longitudinally along the tubular package.

10. The medical device according to claim 1, wherein the connector is disposed external to the tubular package.

11. The medical device according to claim 1, wherein the tubular package is disposable.

12. A method of managing an excess length of a medical laser fiber during a medical procedure, comprising:

coupling a connector of the medical laser fiber to a laser system, the medical laser fiber disposed within a tubular package, wherein:

the tubular package includes a number of sections, and adjacent sections of the number of sections are configured for separation from each other during use of the medical laser fiber;

determining a desired length of the medical laser fiber for use in performing the medical procedure;

removing a portion of the tubular package to expose the desired length of the medical laser fiber; and securing the excess length of the medical laser fiber to the laser system, the excess length disposed within the tubular package.

13. The method according to claim 12, wherein each of the number of sections includes a length marking.

14. The method according to claim 13, wherein each length marking indicates a length of the medical laser fiber extending between the connector and the length marking.

15. The method according to claim 14, wherein determining the desired length of the medical laser fiber includes using the length marking to determine a portion of the tubular package to be removed from the medical laser fiber.

16. The method according to claim 12, wherein removing the tubular package to expose the medical laser fiber includes separating one or more of the adjacent sections from each other.

17. The method according to claim 12, wherein removing the tubular package to expose the medical laser fiber further includes threading one or more number of sections off a distal end of the medical laser fiber.

18. The method according to claim 12, wherein one or more of the number of sections includes a separable seam extending longitudinally along the tubular package.

19. The method according to claim 18, wherein removing the tubular package to expose the medical laser fiber includes separating the separable seam of one or more of the number of sections to expose the medical laser fiber.

20. The method according to claim 12, wherein:

the tubular package defines a rigid coiled shape, and organizing the excess length of the medical laser fiber includes maintaining the excess length of the medical laser fiber within the tubular package.

21. The method according to claim 12, wherein securing the excess length of the medical laser fiber to the laser system includes hanging the tubular package on a hook of the laser system.

* * * * *